US005141599A

United States Patent [19]

Jahn et al.

[11] Patent Number: 5,141,599

[45] Date of Patent: Aug. 25, 1992

[54] RECEIVING MATERIAL FOR INK-JET PRINTING

[75] Inventors: Reiner Jahn; Horst Westfel, both of Belm, Fed. Rep. of Germany

[73] Assignee: Felix Schoeller, Jr. GmbH & Co. KG, Osnabruck, Fed. Rep. of Germany

[21] Appl. No.: 665,601

[22] Filed: Mar. 5, 1991

[30] Foreign Application Priority Data

Mar. 7, 1990 [EP] European Pat. Off. ..... 90104332.3

[51] Int. Cl.[5] ..... D21H 19/80

[52] U.S. Cl. ..... 162/137; 162/168.1; 162/169; 162/174; 162/175; 428/478.2; 428/512; 428/532; 428/537.5

[58] Field of Search ..... 162/134, 135, 137, 174, 162/169, 175, 168.1; 106/130; 427/414; 428/478.2, 532, 512, 537.5

[56] References Cited

U.S. PATENT DOCUMENTS

| | | | |
|---|---|---|---|
| 1,888,560 | 11/1932 | Mauer | 106/130 |
| 2,576,921 | 12/1951 | Buscher | 106/130 |
| 4,503,111 | 3/1985 | Jaeger et al. | 427/414 |

FOREIGN PATENT DOCUMENTS

| | | | |
|---|---|---|---|
| 48-38005 | 11/1973 | Japan | 162/137 |
| 62-239157 | 10/1987 | Japan | 162/137 |

OTHER PUBLICATIONS

Abstract of Japanese Published Application No. 860060751, Mar. 20, 1986, Honshu Paper Mfg. KK.

*Primary Examiner*—Peter Chin

*Attorney, Agent, or Firm*—Lockwood, Alex, FitzGibbon & Cummings

[57] ABSTRACT

A receiving material for ink-jet printing includes a polyolefin coated base paper and an ink receiving layer applied on the front face thereof, and the receiving layer contains a mixture of gelatin and starch.

28 Claims, No Drawings

RECEIVING MATERIAL FOR INK-JET PRINTING

BACKGROUND SUMMARY AND DESCRIPTION OF THE INVENTION

This invention relates to a receiving material with a glossy surface for ink-jet printing. The ink-jet process involves the transference of droplets of an ink-like liquid onto a receiving material by various means. One of the processes is the Hertz process which allows minute droplets of ink, fired through special jets and controlled by digital electronics to produce images of very high definition directly from electronic data.

As ink-jet printing is improved functionally, the demands placed upon the receiving material increase. A picture produced by the ink-jet process should show:

high definition
high color density
an adequate number of color shades/tones
good smudge resistance.

In order to achieve this the following basic requirements must be met:

The receiving material must absorb the ink as quickly as possible.

The ink droplets must:

be sprayed onto the receiving material as exactly as possible in a circular shape, and diffuse slightly and evenly up to a fixed limit.

Ink diffusion in the receiving material must not be too high in order to increase the diameter of the droplets only as much as is absolutely necessary.

The receiving material must present a glossy surface to achieve a high reflection density and a high degree of color brilliance.

Some requirements pose contradictions, i.e. if smudging resistance is acquired too quickly the droplets cannot diffuse correctly and a distinct disadvantage to the clarity of the image created.

With the invention claims for the receiving material in view, it is our object to find a way to achieve an image whose color density and smudge resistance are as high as possible.

A receiving material for multicolored ink-jet printing generally consists of a support material coated with an ink receiving layer. Support materials may be foils of polyester resin, diacetate resin or paper and other materials. The ink receiving layers fundamentally consist of a mixture of pigment/binding agent.

As well as increasing the degree of whiteness of the material, the pigments serve to retain the dyes of the ink in the material surface. A high pigment concentration leads to a high degree of porosity of the layer (DE-PS 30 24 205). This produces desirable smudge resistance standards, but at the same time the pigments penetrate into the inner image receiving materials and this, in turn, worsens the color density of the image.

The application of gelatin coated paper for ink-jet receiving materials is already known (DE-PS 22 34 823). The gelatin is to improve smudge resistance and increase definition qualities. The greatest disadvantage of this receiving material is that the droplets sprayed on to create the image do not become acceptably smudge resistant within the time desired, but only after approximately 10 seconds. A further disadvantage is that the droplets do not run either sufficiently or quickly enough.

The Patent Specification DE-OS 30 167 66 describes a receiving material consisting of a base paper, internally sized to create a defined degree of water absorption, coated with a water soluble polymer. This, it is claimed, produces a printed image of high definition and color density. A disadvantage of this receiving material is the fact that in order to achieve the desired color density, the material must be smoothed in a separate work process after the ink receiving layer has been applied, i.e. by means of a gloss or super calender.

Japanese Patent Specification JP 58-193 185 describes how two coatings are applied to a single support material. The top layer consisting of polyvinyl alcohol ensures good smudge resistance, i.e. quick ink absorption. The bottom layer containing synthetic silicic acid is to ensure high color density. A disadvantage of this receiving material is the unsatisfactory color density, as well as the need for two work processes, i.e. two layers must be applied separately and must finally be smoothed by means of a calender.

It is therefore the object of the present invention to produce a receiving material for the ink-jet process which is not subject to the above listed disadvantages and which distinguishes itself especially by high color density of the printed image in conjunction with a quickly achieved smudge resistance of the ink sprayed.

A further object of the invention is that the receiving material so produced has a glossy surface achieved by as few work processes as possible, wording the necessity for additional smoothing processes.

These objects are achieved by using a polyolefin coated base paper onto which an ink receiving layer has been applied which contains a mixture of gelatin and starch (of a grain size less than 20 μm). The starch is either rice and/or wheat starch, type B. The quantity ratio is preferably between 1:1 and 10:1. One of the forms preferred for the ink receiving layer contains additionally a copolymer containing polar groups such as an acrylate copolymer containing carboxyl groups, metal combined carboxyl groups and/or nitrile groups or a carboxylized vinylidene copolymer among others.

In another preferred form, the quantity of copolymer containing polar groups in the mixture is between 0.5% weight and 35% weight with a preferred quantity of between 4 and 10% weight.

The ink receiving layer may contain all the other usual additives, such as organic or inorganic pigments (polymethylmethacrylate, polystyrene, carbamide formaldehyde resins, silica, $CaCO_3$, $TiO_2$, $BaSO_4$, etc.), hardeners (chrome alum, TAF/formaldehyde), wetting agents (i.e. saponin), shading dyestuffs, antistatic agents and other auxiliary agents.

The coating weights of the ink receiving layer are between 0.5 and 10 g/m$^2$, preferably between 2 and 7 g/m$^2$. The ink receiving coating mass may be applied to the support material by any of the usual coating and metering processes, such as roll coating, nip coating and engraving, as well as air brushing or blade knife metering.

The polyolefin used in the coating of the base paper should preferably be of the low density polyethylene (LDPE) and/or high density polyethylene (HDPE). However, other polyolefins, such as LLDPE or polypropylene may be utilized. The coating weight of this polyolefin layer, in which other additives may be included, should be at least 5 g/m$^2$.

It was surprising that a combination of binding agents in the mixture, i.e. a mixture of at least gelatin and starch, should produce such excellent printed image quality as the single components did not produce correspondingly good results.

The gloss surface of the receiving material according to the invention needs no additional treatment whatsoever, either by means of a gloss calender or any other means, and is obviously achieved by a mutual effect of the polyethylene coated base paper and the ink receiving layer.

Surprisingly, the very good results regarding color density are also achieved without pigmenting the ink receiving layer.

Moreover, the material shows good water-resistance qualities as well as good abrasive resistance of the printed image.

The following examples are to describe the invention more closely, but, however, do not limit it.

EXAMPLE 1

The front side of a polyethylene coated base paper was coated with the following coating solutions:

| Components | Content, % weight | | | | | |
|---|---|---|---|---|---|---|
| | 1a | 1b | 1c | 1d | 1e | 1f |
| Gelatin (220 Bloom) | 10.0 | 10.0 | 10.0 | 10.0 | 10.0 | 10.0 |
| Rice starch (Kaiser/Schäfer), 25% in water | 5.0 | 10.0 | 15.0 | 24.0 | 24.0 | 5.0 |
| Wetting agent (Saponin Q), 5% in water | 1.6 | 1.6 | 1.6 | 1.6 | 1.6 | 1.6 |
| Alcohol mixture | 10.0 | 10.0 | 10.0 | 10.0 | 10.0 | 10.0 |
| Citric acid, 10% in water | 0.3 | 0.3 | 0.3 | 0.3 | 0.3 | 0.3 |
| Chrome alum, 10% in water | 1.5 | 1.5 | 1.5 | 1.5 | 1.5 | 1.5 |
| TAF*/formaldehyde (1:0.3), 2% in water | 1.5 | 1.5 | 1.5 | 1.5 | 1.5 | 1.5 |
| Demineralized water | 70.0 | 65.1 | 60.1 | 51.1 | 51.1 | 70.1 |
| Coating weight, g/m$^2$ | 4.8 | 4.8 | 5.3 | 5.5 | 9.2 | 7.2 |

*TAF — 1,3,5-triacryloyl-hexahydro-s-triazine

The machine speed was 100 m/min, the dryinq temperature was 100° C. and the drying time Was 1-2 min.

The base material used was a base paper coated on both sides with polyethylene and of a basis weight of 175 g/m$^2$.

The back side of the base paper was coated with clear polyethylene, a mix of LDPE and HDPE (35% HDPE with a density of d=b 0.959 g/m$^3$, MFI=8; 40 HDPE with d=0.950 g/cm$^3$, MFI=7; 25% LDPE with d=0.923 g/cm$^3$, MFI=4.4) and applied at a coating weight of 31 g/m$^2$.

The front side was coated at a coating weight of 29 g/m$^2$ with a pigmented polyethylene mixture made up as follows:

| | |
|---|---|
| 24.7% | HDPE with a density d = 0.959 g/cm$^3$, MFI = 8; |
| 19.8% | LDPE with a density d = 0.934 g/cm$^3$, MFI = 3; |
| 33.6% | LDPE with a density d = 0.915 g/cm$^3$, MFI = 8; |
| 20.7% | $TiO_2$ masterbatch with 50% $TiO_2$, MFI 20; |
| 0.2% | ultramarine blue masterbatch with 10% pigment, MFI 5; |
| 1.0% | cobalt violet masterbatch with 40% pigment, MFI 12. |

The calorimetric values of the coated material, produced as above, were: L=96, a=+0.4, b=0.3.

In Example 1*f*, the polyethylene coating of the front side was colored to give the following calorimetric values: L=87.5, a=−0.7, b=+6.1.

The receiving material so produced was then "continuously ink-jet printed" and afterwards analyzed. The results can be seen in Table 1.

EXAMPLE 2

A support material as in Example 1 was coated with the following coating solutions:

| Components | Content, % weight | | | | |
|---|---|---|---|---|---|
| | 2a | 2b | 2c | 2d | 2e |
| Gelatin (Koepff, 220 Bloom) | 9.9 | 9.5 | 9.0 | 8.0 | 6.0 |
| Rice starch (Kaiser/Schäfer), 25% in water | 5.0 | 5.0 | 5.0 | 5.0 | 5.0 |
| Vinylidene chloride copolymer* (Geon 660 × 14, BF Goodrich Co.), 50% dispersion | 0.2 | 1.0 | 2.0 | 4.0 | 8.0 |
| Wetting agent (Saponin Q), 5% in water | 1.6 | 1.6 | 1.6 | 1.6 | 1.6 |
| Alcohol mixture | 10.0 | 10.0 | 10.0 | 10.0 | 10.0 |
| Citric acid, 10% in water | 0.3 | 0.3 | 0.3 | 0.3 | 0.3 |
| Chrome alum, 10% in water | 1.5 | 1.5 | 1.5 | 1.5 | 1.5 |
| TAF/formaldehyde (1:0.3), 2% in water | 1.5 | 1.5 | 1.5 | 1.5 | 1.5 |
| Demineralized water | 70.0 | 9.6 | 69.1 | 68.1 | 66.1 |
| Coating weight, g/m$^2$ | 4.5 | 4.5 | 4.5 | 4.5 | 5.1 |

*Geon 660 × 14 — carboxylized vinylidene chloride copolymer

The other conditions were as in Example 1.

The results of the investigations into the printed image qualities produced by the above can be seen in Table 2.

EXAMPLE 3

A support material as in Example 1 was coated with the following coating solutions:

| Components | Content, % weight | | |
|---|---|---|---|
| | 3a | 3b | 3c |
| Gelatin (Koepff, 220 Bloom) | 9.85 | 9.50 | 6.00 |
| Rice starch (Kaiser/Schäfer), 25% in water | 5.00 | 5.00 | 5.00 |
| Acrylate copolymer* (Primal HG-44, Rohm & Haas Co.), 40% dispersion | 0.25 | 1.25 | 10.00 |
| Wetting agent (Saponin Q), 5% in water | 1.60 | 1.60 | 1.60 |
| Alcohol mixture | 10.00 | 10.00 | 10.00 |
| Citric acid, 10% in water | 0.30 | 0.30 | 0.30 |
| Chrome alum, 10% in water | 1.50 | 1.50 | 1.50 |
| TAF/formaldehyde (1:0.3), 2% in water | 1.50 | 1.50 | 1.50 |
| Demineralized water | 70.00 | 69.35 | 64.10 |
| Coating weight, g/m$^2$ | 4.5 | 4.5 | 5.1 |

*The acrylate copolymer used was one in whose component structure were polar groups containing monomers of 35 mol %.

All other test conditions were as in Example 1.

The results of the investigations into the printed image qualities produced by the above can be seen in Table 3.

EXAMPLE 4

The support material in Example 1 was coated with the following coating solutions:

| Components | Content, % weight | | | | |
|---|---|---|---|---|---|
| | 4a | 4b | 4c | 4d | 4e |
| Gelatin (Koepff, 220 Bloom) | 10.00 | 10.00 | 10.00 | 10.00 | 10.00 |
| Rice starch (Kaiser/Schäfer), 25% in water | 4.95 | 4.85 | 4.70 | 4.50 | 4.70 |

-continued

| Components | Content, % weight | | | | |
|---|---|---|---|---|---|
| | 4a | 4b | 4c | 4d | 4e |
| Org. pigment (Pergopak M2, Ciba-Geigy AG), 10% in water | 0.10 | 0.30 | 0.60 | 1.00 | 0.60 |
| Wetting agent (Saponin Q), 5% in water | 1.60 | 1.60 | 1.60 | 1.60 | 1.60 |
| Alcohol mixture | 10.00 | 10.00 | 10.00 | 10.00 | 10.00 |
| Citric acid, 10% in water | 0.30 | 0.30 | 0.30 | 0.30 | 0.30 |
| Chrome alum, 10% in water | 1.50 | 1.50 | 1.50 | 1.50 | 1.50 |
| TAF/formaldehyde (1:0.3), 2% in water | 1.50 | 1.50 | 1.50 | 1.50 | 1.50 |
| Demineralized water | 70.05 | 69.95 | 69.80 | 69.60 | 69.80 |
| Coating weight, g/m$^2$ | 2.8 | 2.8 | 2.8 | 2.8 | 4.9 |

*The organic pigment used here was a carbamide formulated resin with 0.6% reactive methylol groups.

All other test conditions were as in Example 1.

The result of the investigations into the printed image qualities produced by the above can be seen in Table 4.

COMPARATIVE EXAMPLES

V1. The experiment was carried out as in Example 1. Gelatin (Koepff & Co., 220 Bloom) alone was used as a binding agent.

V2. The experiment was carried out as in Example 1. A mixture of gelatin and cationic starch (Emcoat C, Emsland-Starke GmbH) was used as a binding agent.

V3. A carboxylized vinylidene-chloride copolymer (Geon 660 × 14, BF Goodrich Co.) was used for the ink receiving layer as a binding agent. All other test conditions were as in Example 1.

The ink receiving layers according to V1 to V3 were applied as aqueous solutions made up of the following components:

| Components | Content, % weight | | |
|---|---|---|---|
| | V1 | V2 | V3 |
| Gelatin | 10.0 | 10.0 | — |
| Starch, 5% in water | — | 25.0 | — |
| Vinylidene chloride copolymer, 50% dispersion | — | — | 96.0 |
| Wetting agent (FT-248), 1% in water | — | — | 4.0 |
| Wetting agent (Saponin Q), 5% in water | 1.6 | 1.6 | — |
| Citric acid, 10% in water | 0.3 | 0.3 | — |
| Alcohol mixture | 10.0 | 10.0 | — |
| Chrome alum, 10% in water | 1.5 | 1.5 | — |
| TAF/formaldehyde (1:0.3), 2% in water | 1.5 | 1.5 | — |
| Demineralized water. | 75.1 | 50.1 | — |
| Coating water, g/m$^2$ | 5.1 | 4.7 | 7.7 |

The image receiving material produced in accordance with the comparison examples was continuously ink-jet printed and then analyzed. The results have been compiled in Table 5.

EXAMINATION OF THE IMAGE RECEIVING MATERIAL PRODUCED IN ACCORDANCE WITH EXAMPLES 1 to 4 AND COMPARISON EXAMPLES V1 TO V3

The above mentioned material was printed utilizing the Hertz ink-jet printing principle on an accelerator 4/1120 ink-jet printer from Storck X-cel using the inks developed and recommended by the same company.

The printed samples were examined for color density, smudge resistance, water resistance and gloss.

The density measurements were taken before and after a 24 hour exposure of the images to a Xenon lamp. The apparatus used here was an Original Reflection Densitometer SOS-45. The measurements were taken in the color gradations F1 to F11 for the basic color of cyanogen, magenta red, yellow and black.

The smudge resistance was measured by the degree of so called "sinking" of the printing ink from the surface of the material. The test was carried out separately for all four basic colors.

The smudge resistance of the image was awarded "+" when all the colors immediately and evenly "sank" from the surface, i.e. they penetrated into the inner layer. The mark "O" was awarded when three basic colors sank immediately from the surface and penetrated to the inner layer and the fourth basic color sank within several seconds. Bad smudge resistance of the material was awarded "−" and means that there was little or no "sinking" observed of almost all colors.

A further test examined the water resistance and the abrasion resistance. In order to do this a sample of the material was warmed in water and at intervals of 5° C. was rubbed with a finger. The temperature at which the white of the receiving material first appeared was taken as the degree of water resistance and abrasion resistance.

The gloss of the image receiving material was measured employing a 3-angle gloss measuring apparatus according to Dr. Lange using a measurement angle of 60° C.

The results appearing in the Tables 1 to 5 show that image receiving material according to the invention produces printed images with a high degree of color density while smudge resistance is achieved quickly. At the same time water resistance and abrasion resistance of the same material show better values than the comparison materials.

TABLE 1

Characteristics of the Image Receiving Material Produced and Printed According to Example 1.

| Example | F | Color density | | | | | | | | Smudge Resistance | Water resistance and abrasion resistance °C. | Gloss % |
|---|---|---|---|---|---|---|---|---|---|---|---|---|
| | | cyanogen | | magenta | | yellow | | black | | | | |
| | | a | b | a | b | a | b | a | b | | | |
| 1a | F1 | 2.12 | 2.02 | 1.86 | 1.71 | 1.64 | 1.57 | 1.63 | 1.43 | + | 55 | 29.3 |

TABLE 1-continued

| Example | F | Color density cyanogen a | cyanogen b | magenta a | magenta b | yellow a | yellow b | black a | black b | Smudge Resistance | Water resistance and abrasion resistance °C. | Gloss % |
|---|---|---|---|---|---|---|---|---|---|---|---|---|
| | F5 | 0.77 | 0.79 | 0.74 | 0.64 | 0.71 | 0.69 | 0.97 | 0.84 | | | |
| | F11 | 0.12 | 0.14 | 0.12 | 0.14 | 0.17 | 0.20 | 0.22 | 0.17 | | | |
| 1b | F1 | 2.09 | 1.97 | 1.85 | 1.69 | 1.61 | 1.57 | 1.61 | 1.42 | + | 55 | 26.0 |
| | F5 | 0.80 | 0.78 | 0.73 | 0.63 | 0.70 | 0.69 | 0.99 | 0.84 | | | |
| | F11 | 0.12 | 0.14 | 0.12 | 0.09 | 0.09 | 0.10 | 0.13 | 0.12 | | | |
| 1c | F1 | 2.05 | 1.98 | 1.84 | 1.67 | 1.60 | 1.58 | 1.60 | 1.41 | + | 55 | 24.5 |
| | F5 | 0.81 | 0.81 | 0.73 | 0.63 | 0.69 | 0.68 | 1.00 | 0.85 | | | |
| | F11 | 0.11 | 0.13 | 0.12 | 0.14 | 0.16 | 0.19 | 0.19 | 0.17 | | | |
| 1d | F1 | 2.04 | 1.92 | 1.83 | 1.66 | 1.58 | 1.50 | 1.59 | 1.38 | + | 46 | 21.9 |
| | F5 | 0.70 | 0.69 | 0.69 | 0.58 | 0.65 | 0.63 | 1.03 | 0.85 | | | |
| | F11 | 0.07 | 0.05 | 0.08 | 0.06 | 0.09 | 0.07 | 0.13 | 0.10 | | | |
| 1e | F1 | 2.04 | 1.90 | 1.80 | 1.65 | 1.60 | 1.48 | 1.57 | 1.35 | + | 47 | 23.7 |
| | F5 | 0.68 | 0.68 | 0.69 | 0.57 | 0.64 | 0.63 | 0.98 | 0.86 | | | |
| | F11 | 0.06 | 0.06 | 0.07 | 0.06 | 0.08 | 0.07 | 0.12 | 0.10 | | | |
| 1f | F1 | 2.10 | 2.01 | 1.87 | 1.72 | 1.65 | 1.58 | 1.62 | 1.40 | + | 55 | 26.0 |
| | F5 | 0.80 | 0.78 | 0.73 | 0.65 | 0.70 | 0.70 | 0.97 | 0.82 | | | |
| | F11 | 0.11 | 0.12 | 0.12 | 0.12 | 0.16 | 0.15 | 0.20 | 0.18 | | | |

Characteristics of the Image Receiving Material Produced and Printed According to Example 1.

a — before exposure to Xenon lamp
b — after 24 hours exposure to Xenon lamp
+ = good
∘ = medium
− = bad

TABLE 2

| Example | F | Color density cyanogen a | cyanogen b | magenta a | magenta b | yellow a | yellow b | black a | black b | Smudge Resistance | Water resistance and abrasion resistance °C. | Gloss % |
|---|---|---|---|---|---|---|---|---|---|---|---|---|
| 2a | F1 | 2.00 | 1.88 | 1.73 | 1.51 | 1.53 | 1.47 | 1.56 | 1.25 | + | 65 | 26.6 |
| | F5 | 0.72 | 0.69 | 0.66 | 0.56 | 0.57 | 0.55 | 1.01 | 0.79 | | | |
| | F11 | 0.08 | 0.08 | 0.09 | 0.10 | 0.05 | 0.05 | 0.12 | 0.13 | | | |
| 2b | F1 | 2.04 | 1.92 | 1.83 | 1.66 | 1.58 | 1.50 | 1.59 | 1.38 | + | 60 | 25.9 |
| | F5 | 0.70 | 0.69 | 0.69 | 0.58 | 0.65 | 0.63 | 1.02 | 0.86 | | | |
| | F11 | 0.07 | 0.05 | 0.08 | 0.06 | 0.09 | 0.07 | 0.13 | 0.10 | | | |
| 2c | F1 | 2.05 | 1.95 | 1.80 | 1.63 | 1.59 | 1.51 | 1.60 | 1.40 | + | 55 | 23.9 |
| | F5 | 0.74 | 0.73 | 0.69 | 0.59 | 0.60 | 0.56 | 1.04 | 0.85 | | | |
| | F11 | 0.09 | 0.06 | 0.10 | 0.07 | 0.06 | 0.03 | 0.13 | 0.10 | | | |
| 2d | F1 | 1.97 | 1.84 | 1.81 | 1.65 | 1.56 | 1.51 | 1.57 | 1.39 | + | 50 | 22.4 |
| | F5 | 0.74 | 0.73 | 0.68 | 0.62 | 0.61 | 0.59 | 1.03 | 0.87 | | | |
| | F11 | 0.11 | 0.09 | 0.08 | 0.07 | 0.06 | 0.05 | 0.13 | 0.10 | | | |
| 2e | F1 | 1.95 | 1.76 | 1.73 | 1.49 | 1.55 | 1.46 | 1.54 | 1.32 | ∘ | 50 | 20.5 |
| | F5 | 0.71 | 0.69 | 0.66 | 0.57 | 0.55 | 0.54 | 1.00 | 0.80 | | | |
| | F11 | 0.09 | 0.06 | 0.10 | 0.06 | 0.05 | 0.03 | 0.12 | 0.09 | | | |

Characteristics of the Image Receiving Material Produced and Printed According to Example 2.

a — before exposure to Xenon lamp
b — after 24 hours exposure to Xenon lamp
+ = good
∘ = medium
− = bad

TABLE 3

| Example | F | Color density cyanogen a | cyanogen b | magenta a | magenta b | yellow a | yellow b | black a | black b | Smudge Resistance | Water resistance and abrasion resistance °C. | Gloss % |
|---|---|---|---|---|---|---|---|---|---|---|---|---|
| 3a | F1 | 2.06 | 1.94 | 1.86 | 1.72 | 1.63 | 1.63 | 1.63 | 1.46 | + | 50 | 22.6 |
| | F5 | 0.73 | 0.75 | 0.73 | 0.67 | 0.70 | 0.72 | 1.06 | 0.92 | | | |
| | F11 | 0.08 | 0.11 | 0.11 | 0.15 | 0.15 | 0.19 | 0.19 | 0.17 | | | |
| 3b | F1 | 2.05 | 2.00 | 1.83 | 1.63 | 1.59 | 1.47 | 1.60 | 1.36 | + | 50 | 21.6 |
| | F5 | 0.71 | 0.68 | 0.69 | 0.57 | 0.67 | 0.59 | 1.01 | 0.83 | | | |
| | F11 | 0.07 | 0.07 | 0.09 | 0.09 | 0.09 | 0.10 | 0.13 | 0.12 | | | |
| 3c | F1 | 2.02 | 1.99 | 1.81 | 1.60 | 1.50 | 1.50 | 1.61 | 1.35 | ∘ | 50 | 19.1 |
| | F5 | 0.70 | 0.70 | 0.68 | 0.56 | 0.57 | 0.57 | 1.00 | 0.90 | | | |

Characteristics of the Image Receiving Material Produced and Printed According to Example 3.

TABLE 3-continued

| Example | F | Color density cyanogen a | cyanogen b | magenta a | magenta b | yellow a | yellow b | black a | black b | Smudge Resistance | Water resistance and abrasion resistance °C. | Gloss % |
|---|---|---|---|---|---|---|---|---|---|---|---|---|
| | F11 | 0.07 | 0.06 | 0.08 | 0.08 | 0.09 | 0.09 | 0.12 | 0.11 | | | |

Characteristics of the Image Receiving Material Produced and Printed According to Example 3.

a — before exposure to Xenon lamp
b — after 24 hours exposure to Xenon lamp
+ = good
∘ = medium
− = bad

TABLE 4

Characteristics of the Image Receiving Material Produced and Printed According to Example 4.

| Example | F | Color density cyanogen a | cyanogen b | magenta a | magenta b | yellow a | yellow b | black a | black b | Smudge Resistance | Water resistance and abrasion resistance °C. | Gloss % |
|---|---|---|---|---|---|---|---|---|---|---|---|---|
| 4a | F1 | 2.10 | 2.00 | 1.85 | 1.70 | 1.63 | 1.58 | 1.62 | 1.44 | + | 55 | 29.0 |
| | F5 | 0.76 | 0.77 | 0.74 | 0.65 | 0.70 | 0.69 | 0.99 | 0.84 | | | |
| | F11 | 0.12 | 0.14 | 0.12 | 0.12 | 0.17 | 0.20 | 0.20 | 0.18 | | | |
| 4b | F1 | 2.07 | 1.98 | 1.84 | 1.70 | 1.64 | 1.57 | 1.60 | 1.45 | + | 54 | 27.5 |
| | F5 | 0.74 | 0.75 | 0.72 | 0.62 | 0.72 | 0.68 | 1.02 | 0.89 | | | |
| | F11 | 0.09 | 0.10 | 0.12 | 0.11 | 0.17 | 0.18 | 0.20 | 0.17 | | | |
| 4c | F1 | 2.09 | 1.96 | 1.90 | 1.69 | 1.66 | 1.56 | 1.63 | 1.45 | + | 52 | 23.8 |
| | F5 | 0.75 | 0.75 | 0.73 | 0.64 | 0.73 | 0.69 | 1.04 | 0.89 | | | |
| | F11 | 0.09 | 0.12 | 0.16 | 0.14 | 0.21 | 0.20 | 0.20 | 0.17 | | | |
| 4d | F1 | 2.05 | 1.98 | 1.91 | 1.70 | 1.65 | 1.55 | 1.61 | 1.43 | + | 54 | 21.8 |
| | F5 | 0.74 | 0.73 | 0.71 | 0.63 | 0.73 | 0.70 | 1.02 | 0.90 | | | |
| | F11 | 0.08 | 0.08 | 0.09 | 0.12 | 0.20 | 0.19 | 0.19 | 0.16 | | | |
| 4e | F1 | 2.09 | 1.97 | 1.85 | 1.69 | 1.61 | 1.57 | 1.61 | 1.42 | + | 52 | 23.7 |
| | F5 | 0.80 | 0.78 | 0.73 | 0.63 | 0.70 | 0.69 | 0.99 | 0.84 | | | |
| | F11 | 0.12 | 0.14 | 0.12 | 0.14 | 0.16 | 0.20 | 0.19 | 0.17 | | | |

a — before exposure to Xenon lamp
b — after 24 hours exposure to Xenon lamp
+ = good
∘ = medium
− = bad

TABLE 5

Characteristics of the Image Receiving Material Produced and Printed According to the Comparison Examples V1 to V3.

| Example | F | Color density cyanogen a | cyanogen b | magenta a | magenta b | yellow a | yellow b | black a | black b | Smudge Resistance | Water resistance and abrasion resistance °C. | Gloss % |
|---|---|---|---|---|---|---|---|---|---|---|---|---|
| V1 | F1 | 1.95 | 1.49 | 1.69 | 1.35 | 1.49 | 1.29 | 1.51 | 1.41 | ∘ | 21.4 | 34 |
| | F5 | 0.65 | 0.52 | 0.60 | 0.54 | 0.54 | 0.51 | 0.90 | 0.89 | | | |
| | F11 | 0.07 | 0.05 | 0.08 | 0.05 | 0.05 | 0.03 | 0.10 | 0.09 | | | |
| V2 | F1 | 1.97 | 1.51 | 1.68 | 1.29 | 1.47 | 1.25 | 1.50 | 1.42 | ∘ | 19.2 | 37 |
| | F5 | 0.64 | 0.51 | 0.61 | 0.55 | 0.51 | 0.50 | 0.95 | 0.91 | | | |
| | F11 | 0.06 | 0.06 | 0.07 | 0.04 | 0.03 | 0.03 | 0.10 | 0.08 | | | |
| V3 | F1 | — | — | — | — | — | — | — | — | sticks | — | — |
| | F5 | | | | | | | | | | | |
| | F11 | | | | | | | | | | | |

Characteristics of the Image Receiving Material Produced and Printed According to the Comparison Examples V1 to V3.

a — before exposure to Xenon lamp
b — after 24 hours exposure to Xenon lamp
+ = good
∘ = medium
− = bad

We claim:

1. A receiving material with a gloss surface for ink jet printing comprising:

a support material including a polyolefin coated base paper; and an ink receiving layer coated on said support material containing a protein binding agent comprising a mixture of gelatin and starch of a grain size of less than about 20 μm, and wherein the ratio of gelatin to starch is between about 1:1 and 10:1.

2. The receiving material of claim 1, wherein the ink receiving layer additionally contains a copolymer which contains polar groups.

3. The receiving material of claim 2, wherein the copolymer is a carboxylized vinylidene chloride copolymer.

4. The receiving material of claim 2, wherein the copolymer is an acrylate copolymer which contains groups consisting essentially of carboxyl groups, metal combined carboxyl groups, nitrile groups and combinations thereof.

5. The receiving material of claim 2, wherein the quantity of the copolymer which contains the polar groups in the ink receiving layer is between about 0.5 and 35% weight.

6. The receiving material of claim 5, wherein said quantity is between about 4 and 10% weight.

7. The receiving material of claim 3, wherein the quantity of the copolymer which contains the polar groups in the ink receiving layer is between about 0.5 and 35% weight.

8. The receiving material of claim 7, wherein said quantity is between about 4 and 10% weight.

9. The receiving material of claim 4, wherein the quantity of the copolymer which contains the polar groups in the ink receiving layer is between about 0.5 and 35% weight.

10. The receiving material of claim 9, wherein said quantity is between about 4 and 10% weight.

11. The receiving material of claim 1, wherein the ink receiving layer additionally contains organic and/or inorganic pigments.

12. The receiving material of claim 11, wherein the organic pigment is a carbamide formaldehyde resin containing reactive methylol groups.

13. The receiving material of claim 2, wherein the ink receiving layer additionally contains organic and/or inorganic pigments.

14. The receiving material of claim 13, wherein the organic pigment is a carbamide formaldehyde resin containing reactive methylol groups.

15. The receiving material of claim 3, wherein the ink receiving layer additionally contains organic and/or inorganic pigments.

16. The receiving material of claim 15, wherein the organic pigment is a carbamide formaldehyde resin containing reactive methylol groups.

17. The receiving material of claim 4, wherein the ink receiving layer additionally contains organic and/or inorganic pigments.

18. The receiving material of claim 17, wherein the organic pigment is a carbamide formaldehyde resin containing reactive methylol groups.

19. The receiving material of claim 1, wherein the ink receiving layer contains other additives selected from the group consisting essentially of hardening agents, wetting agents, shading dyes, antistatics, and other auxiliary agents.

20. The receiving material of claim 1, wherein the coating weight of the ink receiving layer is between about 0.5 and 10 $g/m^2$.

21. The receiving material of claim 20, wherein said coating weight is between about 2and 7 $g/m^2$.

22. The receiving material of claim 1, wherein the polyolefin coating is a mixture of LDPE and HDPE.

23. The receiving material of claim 1, wherein the polyolefin coating weight is at least about 5 $g/m^2$.

24. The receiving material of claim 1, wherein the polyolefin coating weight is between about 15 and 35 $g/m^2$.

25. The receiving material of claim 1, wherein said starch is a rice starch.

26. The receiving material of claim 2, wherein said starch is a rice starch.

27. The receiving material of claim 1, wherein said starch is a type B wheat starch.

28. The receiving material of claim 2, wherein said starch is a type B wheat starch.

* * * * *

UNITED STATES PATENT AND TRADEMARK OFFICE

CERTIFICATE OF CORRECTION

PATENT NO. : 5,141,599

DATED : August 25, 1992

INVENTOR(S) : Jahn et al

It is certified that error appears in the above-indentified patent and that said Letters Patent is hereby corrected as shown below:

Col. 3, line 38, delete "Was" and insert --was--.
Col. 3, line 44, delete "d=b 0.959" and insert --d=0.959--.
Col. 12, line 19, delete "2and" and insert --2 and--.

Signed and Sealed this

Twelfth Day of March, 1996

*Attest:*

*Attesting Officer*

BRUCE LEHMAN

*Commissioner of Patents and Trademarks*